US009161677B2

(12) United States Patent
Hofpeter et al.

(10) Patent No.: US 9,161,677 B2
(45) Date of Patent: Oct. 20, 2015

(54) SILVERWARE CONTAINER, ESPECIALLY SILVERWARE TRAY AND/OR SILVERWARE BASKET, AS WELL AS DISHWASHER WITH SUCH A SILVERWARE CONTAINER

(75) Inventors: Claudia Hofpeter, Furth, DE (US); Oliver Kleinert, Lidingo (SE); Anna Hnatow, Eckental (DE); Winfried Steiner, Nuremberg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 361 days.

(21) Appl. No.: 13/389,736

(22) PCT Filed: Aug. 27, 2010

(86) PCT No.: PCT/EP2010/005252

§ 371 (c)(1), (2), (4) Date: Feb. 9, 2012

(87) PCT Pub. No.: WO2011/026588

PCT Pub. Date: Mar. 10, 2011

(65) Prior Publication Data

US 2012/0139400 A1 Jun. 7, 2012

(30) Foreign Application Priority Data

Sep. 3, 2009 (EP) ..... 09011294

(51) Int. Cl.
*A47L 15/50* (2006.01)

(52) U.S. Cl.
CPC ..... *A47L 15/502* (2013.01); *A47L 15/505* (2013.01)

(58) Field of Classification Search
CPC ... A47L 15/502; A47L 15/504; A47L 15/505; A47L 15/50; A47L 19/04; A47L 15/501; A47L 15/503; A47B 45/00; B65D 21/086; B65D 21/0212; B65D 25/2888
USPC ..... 211/41.1–41.9, 88.02, 88.01, 126.1, 211/126.6, 132.1, 113; 220/487, 488; 134/135
See application file for complete search history.

(56) References Cited

U.S. PATENT DOCUMENTS 1,691,858 A 11/1928 Ryerson
1,714,266 A * 5/1929 Johnson ..... 220/8

(Continued)

FOREIGN PATENT DOCUMENTS

CN 101563016 A 10/2009
DE 1 917 909 U 6/1965

(Continued)

OTHER PUBLICATIONS

International Search Report and Written Opinion for International Application No. PCT/EP2010/005252, mailed Dec. 14, 2010.

(Continued)

*Primary Examiner* — Patrick Hawn
(74) *Attorney, Agent, or Firm* — Alston & Bird LLP

(57) ABSTRACT

The invention relates to a silverware container (1, 40), especially a silverware basket and/or a silverware tray, for arrangement on a crockery basket (2) of a dishwasher, wherein the silverware container (1) comprises two opposing ends (16A, 14A; 16B, 14B) that are adapted for arrangement on the upper ends of two opposing side walls (3,4) of the crockery basket (2) or the silverware container (40) is adapted for arrangement on the bottom (21) of the crockery basket (2), characterized in that the silverware container (1, 40) comprises a bottom wall (18; 46A, 46B) for supporting the silverware that comprises at least two essentially horizontal segments (18A, 18B; 46A, 46B) that are arranged telescopably relative to each other. Furthermore, the invention relates to a dishwasher comprising a crockery basket (2) comprising a silverware container (1, 40), a silverware tray (1) and/or a silverware basket (40) according to the invention.

16 Claims, 4 Drawing Sheets

(56) References Cited

U.S. PATENT DOCUMENTS

Figure 1:
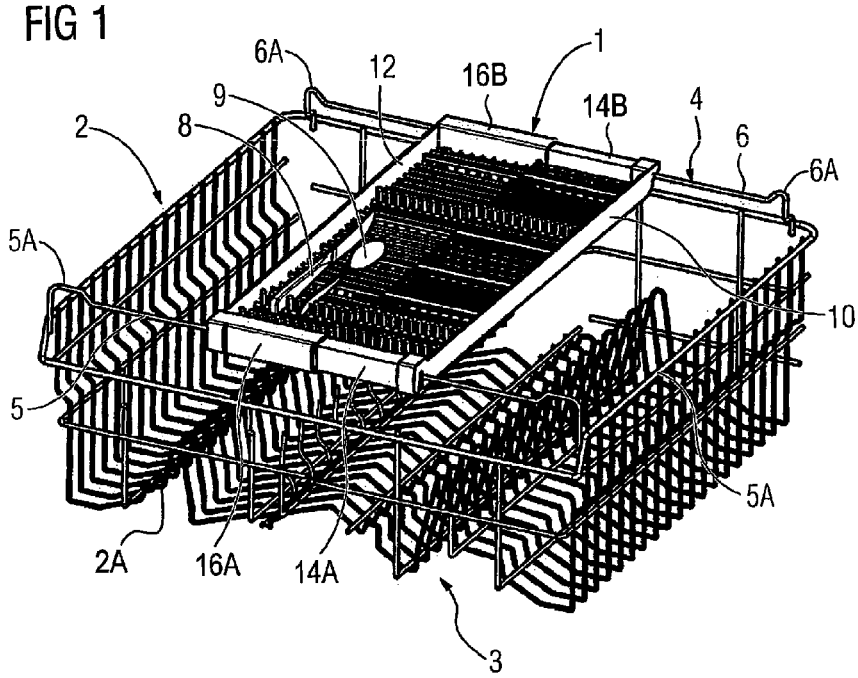

| | | | | |
|---|---|---|---|---|
| 2,600,096 | A * | 6/1952 | Cooper et al. | 211/41.2 |
| 3,887,102 | A * | 6/1975 | Earley | 220/8 |
| 3,935,958 | A * | 2/1976 | Frangos | 220/488 |
| 4,372,448 | A | 2/1983 | Drach | |
| 4,564,118 | A * | 1/1986 | Heyer et al. | 220/8 |
| 5,016,772 | A * | 5/1991 | Wilk | 220/8 |
| 5,083,827 | A * | 1/1992 | Hollenbaugh, Sr. | 296/37.1 |
| 5,431,294 | A * | 7/1995 | Stottmann et al. | 220/23.4 |
| 5,462,348 | A | 10/1995 | Ellingson et al. | |
| 5,881,906 | A * | 3/1999 | Rogers et al. | 220/607 |
| 6,467,622 | B1 * | 10/2002 | Hull | 206/553 |
| 7,445,128 | B2 | 11/2008 | Kaczmarek | |
| 7,458,473 | B1 * | 12/2008 | Mason | 211/59.3 |
| 7,464,827 | B2 * | 12/2008 | Meissen | 220/8 |
| 7,478,642 | B2 * | 1/2009 | Koch et al. | 134/135 |
| 8,522,998 | B2 | 9/2013 | Crookshanks et al. | |
| 2004/0079713 | A1 | 4/2004 | Wendt et al. | |
| 2005/0167374 | A1 | 8/2005 | Yang et al. | |
| 2005/0178412 | A1 | 8/2005 | Koch et al. | |
| 2006/0113260 | A1 * | 6/2006 | Purushothaman et al. | 211/41.8 |
| 2006/0243681 | A1 | 11/2006 | Bastuji et al. | |
| 2007/0039636 | A1 | 2/2007 | Egger et al. | |
| 2007/0090063 | A1 * | 4/2007 | Schmidt | 211/41.3 |
| 2008/0072937 | A1 | 3/2008 | Choi et al. | |
| 2008/0110480 | A1 * | 5/2008 | Choi et al. | 134/135 |
| 2008/0169009 | A1 | 7/2008 | Mailander | |
| 2009/0140619 | A1 | 6/2009 | Buehlmeyer et al. | |
| 2010/0051069 | A1 | 3/2010 | Schessl et al. | |
| 2012/0139400 | A1 | 6/2012 | Hofpeter et al. | |

FOREIGN PATENT DOCUMENTS

| | | | |
|---|---|---|---|
| DE | 7008981 | U | 7/1970 |
| DE | 7032937 | U | 12/1970 |
| DE | 43 09 915 | A1 | 9/1994 |
| DE | 195 40 611 | A1 | 5/1997 |
| DE | 299 01 901 | U1 | 6/2000 |
| EP | 1 072 221 | A1 | 1/2001 |
| ES | 2 168 937 | A1 | 6/2002 |
| GB | 2 042 147 | A | 9/1980 |
| WO | WO-03/055375 | A1 | 7/2003 |
| WO | WO 03/055376 | A1 | 7/2003 |
| WO | WO 2004/000090 | A1 | 12/2003 |
| WO | WO-2005/037051 | A1 | 4/2005 |
| WO | WO-2005/041744 | A1 | 5/2005 |
| WO | WO-2006/056515 | A1 | 6/2006 |
| WO | WO 2008/035866 | A1 | 3/2008 |
| WO | WO-2008/061869 | A1 | 5/2008 |

OTHER PUBLICATIONS

European Search Report for Application No. EP 09 01 1294 dated Feb. 3, 2010.

Office Action for European Application No. EP 09 011 294.7 dated Feb. 1, 2013.

European Search Report for Application No. EP 10 00 2618 dated Jul. 19, 2010.

International Search Report for Application No. PCT/EP2011/001202, dated Jan. 25, 2012.

* cited by examiner

SILVERWARE CONTAINER, ESPECIALLY SILVERWARE TRAY AND/OR SILVERWARE BASKET, AS WELL AS DISHWASHER WITH SUCH A SILVERWARE CONTAINER

CROSS REFERENCE TO RELATED APPLICATIONS

This application is a national stage application filed under 35 U.S.C. 371 of International Application No. PCT/EP2010/005252, filed Aug. 27, 2010, which claims priority from European Application No. 09011294.7, filed Sep. 3, 2009, each of which is incorporated herein in its entirety.

The present invention relates to a silverware container, especially a silverware tray and/or a silverware basket, for arrangement on a crockery basket of a dishwasher, as well as dishwasher with a silverware container.

Silverware containers, for example as a silverware tray with a crockery basket for a dishwasher are, for example, known from DE 43 09 915 C2. The dishwasher described therein comprises a basket, which can be moved between a washing position, in which the basket is located fully inside a washing chamber of the dishwasher, and a loading position, in which the basket is moved out of the washing chamber and can be loaded with dishes to be washed or unloaded when the dishes are clean. The basket comprises two opposite side walls each having a horizontal bar, on which a silverware tray is slidably mounted. Although the silverware tray only covers a certain part of the top of the basket, it has to be frequently moved to fully load/unload the basket, which is annoying for the user. On the one hand it is therefore desired that the tray is rather small so that it always covers only a very small part of the top of the basket. On the other hand it is desired to make the silverware tray as big as possible, so that a large quantity of silverware can be placed on the tray and washed in a single washing process. These are opposing desires, which depend on the quantity of dishes and silverware to be cleaned. However, since this quantity often varies, it is hard to decide whether to prefer a big silverware tray or a small one.

Starting from the above mentioned prior art technology it is an object of the present invention to provide a silverware container for arrangement on a crockery basket of a dishwasher and a dishwasher with a silverware container which are easy and flexible to use.

This object is solved by a silverware container for arrangement on a crockery basket of a dishwasher, wherein the silverware container comprises two opposing ends that are adapted for arrangement on the upper ends of two opposing side walls of the crockery basket or the silverware container is adapted for arrangement on the bottom of the crockery basket, characterized in that the silverware container comprises a bottom wall for supporting the silverware that comprises at least two essentially horizontal segments that are arranged telescopably relative to each other.

This silverware container according to the invention allows a very simple and robust construction. Furthermore, as it comprises at least two essentially horizontal segments that are arranged telescopably relative to each other, the arrangement of the two essentially horizontal segments can be adapted as currently needed so that the silverware container is very flexible to use.

Preferably, the silverware container is a cutlery container and/or a container for knifes, forks and spoons, which not necessarily need to be made of or contain silver. Instead, the cutlery can also be made of other metal, metal compounds, metal alloys, plastics or other suitable materials.

Preferably, the horizontal segments of its or the bottom wall are telescopably perpendicularly to its opposing ends that are adapted for arrangement on the upper ends of the opposing side walls of the crockery basket. This allows an easy telescoping of the silverware container.

In an advantageous embodiment, at least its or the bottom wall comprises openings, in particular slots, through holes and/or mesh holes so that water can get into and/or out of the silverware container. This improves the rinsing quality when the silverware container is sprayed with rinsing liquid and/or water.

Preferably, at least the area of the bottom wall, in particular in addition the area of two opposing side walls of the silverware container, can be adapted by telescoping at least the telescopable horizontal segments of the bottom wall. In case the area of the bottom wall can be adapted, the area which is necessary for the silverware container can be selected as small as necessary for placing the silverware in it, so that the area which is left for other items can be maximized.

Preferably, the silverware container is a silverware tray or a silverware basket for arrangement on a crockery basket of dishwasher. A silverware tray reduces or minimises the height which is necessary for placing the silverware, whereas a silverware basket increases or maximizes the amount of silverware which can be placed into the basket.

Preferably, the silverware container is a silverware tray, a) that comprises a first guiding means and a second guiding means that are arranged respectively at opposing ends of the silverware tray as well as at least two tray elements that comprise the telescopable horizontal segments of its bottom wall, b) wherein the first guiding means is supported and telescopably arranged on the upper end of the first side wall of the crockery basket and the second guiding means is supported and telescopably arranged on the upper end of the second side wall of the crockery basket, c) whereas the size of the silverware tray is variable by telescoping the tray elements perpendicularly to the opposing ends of the silverware tray and using the guiding means as telescopic guidance.

In this case, the silverware container can be arranged at the upper end of the crockery basket so that the lower area of the crockery basket can be used for other items whereas the silverware can be placed above these items. Furthermore, the guiding means allow easy telescoping of the tray elements.

Preferably, both the first and the second guiding means each comprises two elongated halves that are slidably arranged in parallel and/or concentrically to each other, preferably wherein the two halves of each guiding means are arranged on two neighbouring tray elements at corresponding ends thereof.

Preferably, the first guiding means is supported and telescopably arranged on a first upper side wire of the first side wall of the crockery basket, and/or the second guiding means of the silverware tray is supported and telescopably arranged on a second upper side wire of the second side wall of the crockery basket, wherein the upper side wire of the crockery basket extends at least essentially along the upper side of the respective side wall thereof, preferably at least substantially horizontally, preferably wherein the tray elements are telescopably along the first and the second side wire of the crockery basket. The upper side wires allow a safe guidance of the silverware container. Furthermore, in many cases, the upper side wires are existing anyway so that the guidance can be manufactured with at least relatively low or even no additional costs.

Preferably, the guiding means guide the movement of the tray elements, both relatively to each other and relatively to the first and second side wall of the cutlery basket, in particular wherein at least one guiding means encompasses an upper side wire of the crockery basket. In this embodiment, the guiding means are therefore used in two different ways which can reduce the number of parts and the amount of space which is necessary and which can also reduce the manufacturing costs.

Preferably, at least one of the guiding means comprises an abutment means for detachably arranging the silverware tray on a side wall, preferably on an upper side wire, of the crockery basket, wherein preferably at least one abutment means comprises at least one recess, which is resiliently clipable on a side wall, in particular on an upper side wire, of the crockery basket, and/or at least one of the guiding means is pivotably engaged with one of the opposing side walls, in particular with one upper side wire, of the crockery basket, and/or at least one of the guiding means comprises a stopper for limiting the movement of at least one tray element relative to a neighbouring tray element or relative to the first or second side wall of the crockery basket.

Preferably, the silverware tray can be arranged on a crockery basket, a) wherein at least one of the side walls of the crockery basket, in particular at least one of the upper side wires thereof, comprises a stop at at least one of its ends for limiting the sliding movement of the silverware tray,
b) wherein preferably the stops are provided as upwardly extending sections of the upper side wire.

Therefore, a sliding movement to a or within an unintended range can be avoided.

Preferably, the silverware container is a silverware basket, a) comprising a bottom wall, a front wall and a back wall and two opposing side walls,
b) wherein the size of the silverware basket is, preferably horizontally, variable by telescoping the bottom wall and preferably the two side walls.

Preferably, the silverware basket a) comprises at least two basket halves, each basket half comprising a telescopable horizontal segment of the bottom wall of the silverware basket and either the front wall or the back wall thereof and a telescopable segment of at least one side wall thereof, preferably two telescopable segment of two opposing side walls,
b) wherein the basket halves are shiftable into each other to form the silverware basket and/or
c) wherein the basket halves are telescopable with respect to each other for varying the size of the silverware basket, in particular
d) wherein an additional intermediate basket part that comprises two opposing side walls and a base area can be arranged between the two basket halves.

Preferably, the silverware basket comprises a linear guidance in a side wall and/or in the bottom wall. This improves the guidance of the telescoping movement.

Preferably, at least one of the side walls, the front wall and/or the back wall in addition to the bottom wall comprise openings, in particular slots, through holes and/or mesh holes so that water can get into and/or out of the silverware basket. This can improve the rinsing quality, as more water and/or rinsing agent can pass the silverware.

Preferably, at least one of the front walls and/or the back wall has a height that is adapted to hold the silverware at least essentially in an upright position. This allows an easy loading and unloading of the container.

Preferably, the silverware basket comprises a handle which spans between the two opposite side walls. This allows an easy carrying of the container.

Furthermore, the invention relates to a dishwasher comprising a crockery basket comprising a silverware container, a silverware tray and/or a silverware basket according to at least one of the invention.

The detailed configuration, figures and advantageous of the present invention will become apparent in the course of the following description with reference to the accompanying drawings.

Figure 2:
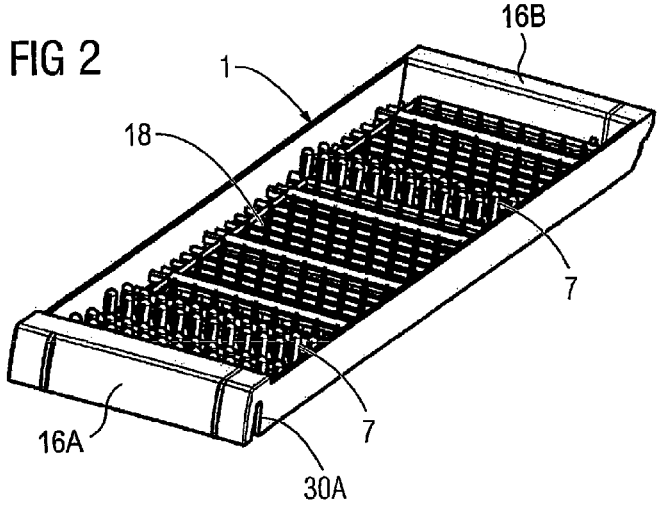
Figure 3:
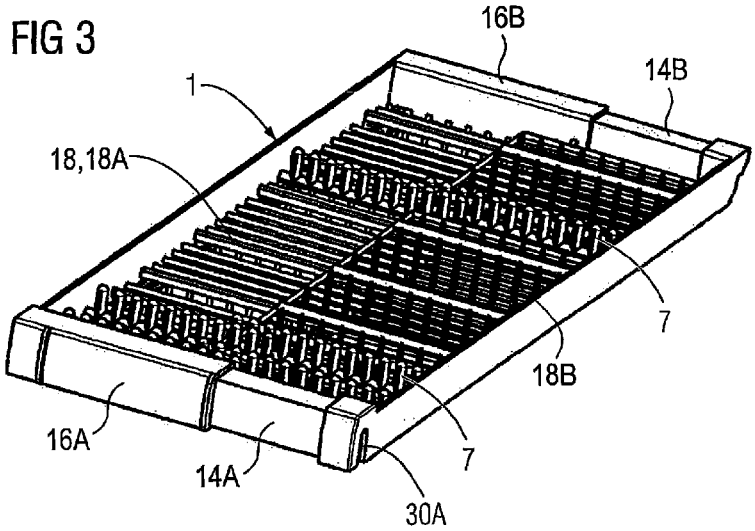
Figure 4:
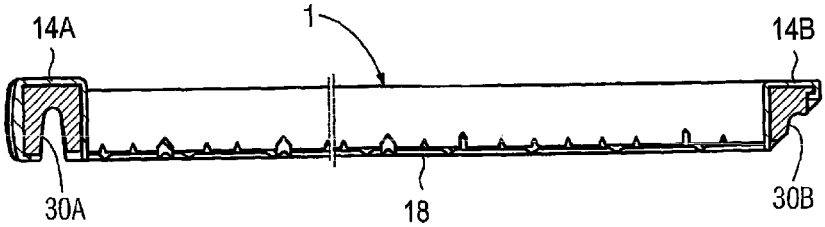
Figure 5:
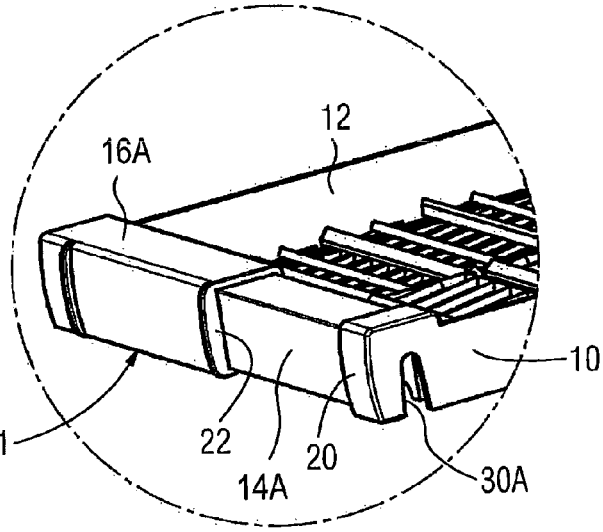
Figure 6:
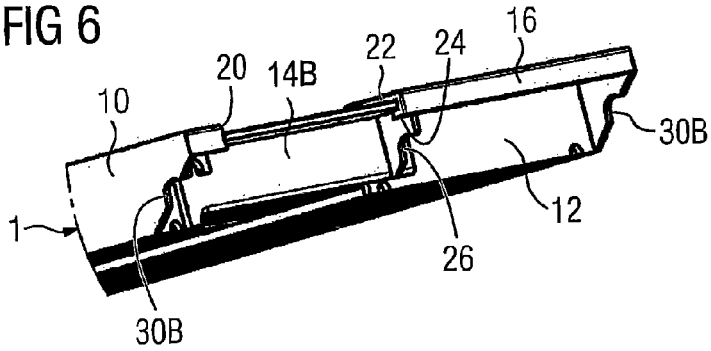
Figure 7:
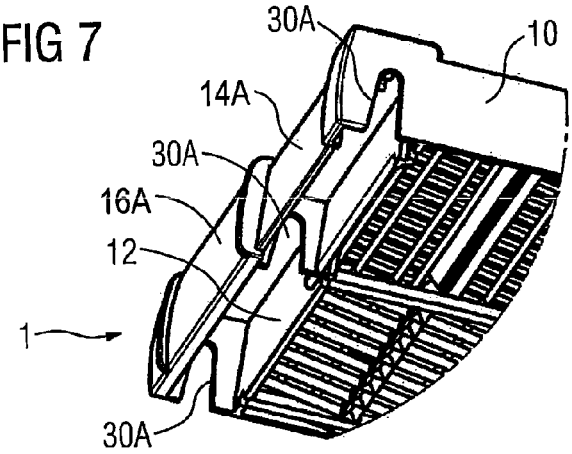
Figure 8:
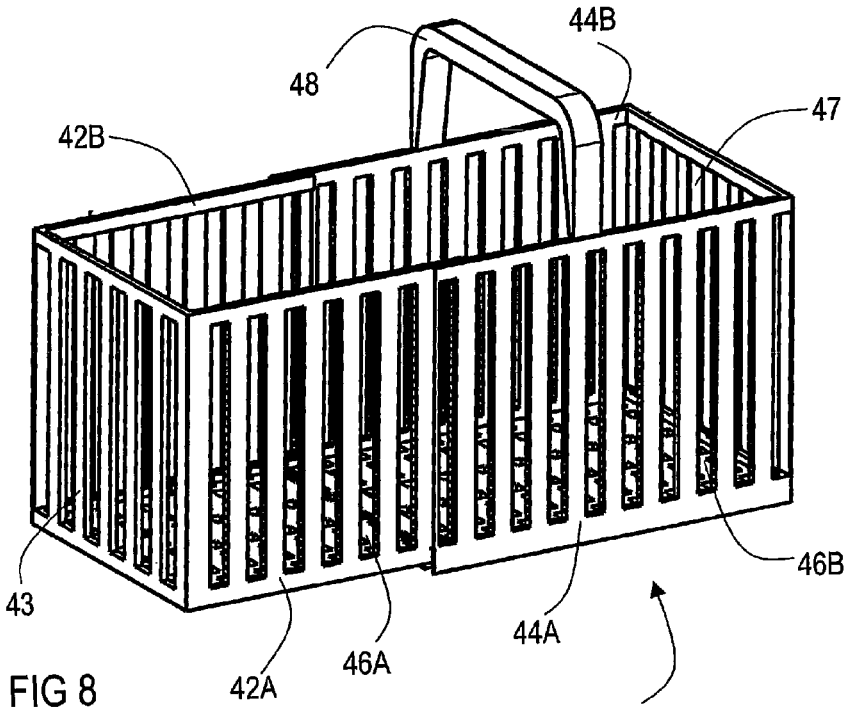
Figure 9:
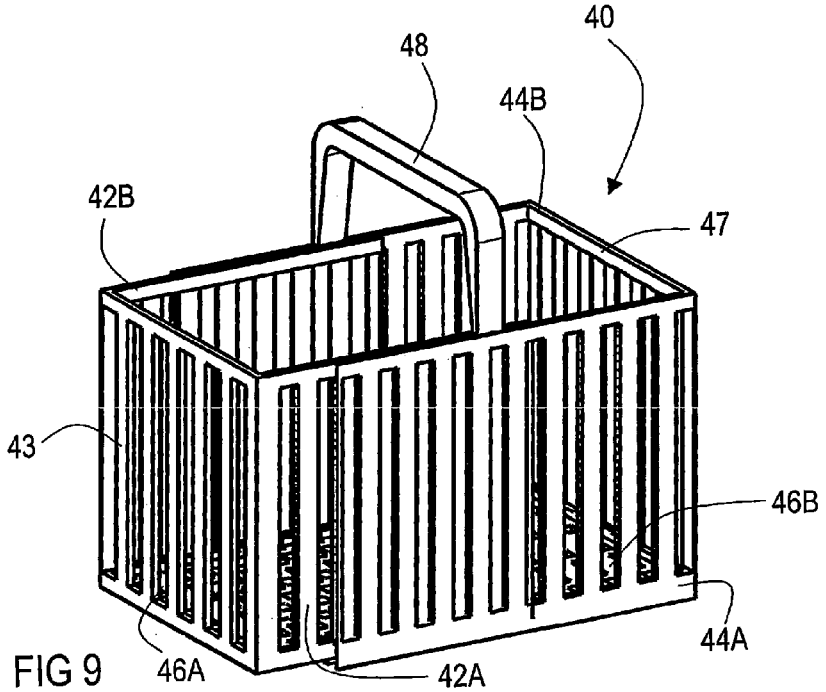

FIG. 1 is a perspective view showing a dishwasher basket and a silverware tray according to an embodiment of the present invention, FIG. 2 is a perspective view showing the silverware tray of FIG. 1 when provided with its minimum size, FIG. 3 is a perspective view showing the silverware tray of FIG. 1 expanded to maximum size, FIG. 4 is a cross sectional view of the silverware tray from FIG. 1, FIG. 5 is a partial perspective view showing the guiding means of the silverware tray of FIG. 1, FIG. 6 is a partial perspective view showing the guide elements of the silverware tray from FIG. 1, FIG. 7 is a partial perspective view showing the guiding means of FIG. 5 from below, FIG. 8 is a perspective view of a silverware basket according to the invention in its maximum size and FIG. 9 is a perspective view of a silverware basket according to the invention in its minimum size.

Below, embodiments of the present invention will be described with reference to the figures. In the figures, like parts or portions are denoted by like reference numbers, and redundant description will be omitted.

FIG. 1 shows a silverware tray 1 and a dishwasher basket 2 according to an embodiment of the present invention.

The dishwasher basket (or: crockery basket) 2 comprises a bottom 2A and a front and a rear side wall 3, 4 (or: side mesh) having respective horizontal bars (or: upper side wires) 5, 6 extending along their length. The horizontal bars 5, 6 are upwardly bent at their lateral ends to form stops 5A and 6A. The horizontal bars 5, 6 slidably receive the tray 1, whereas the stops 5A, 6A limit the sliding movement of the tray 1 along the bars 5, 6 in both directions.

The silverware tray 1 which is also shown in FIGS. 2 to 7, is made of plastic material. In its central tray area on the bottom wall 18 with telescopable horizontal segments 18A and 18B it is provided with upright pins 7, which are arranged in lines for receiving the silverware 8, 9, which is represented by a knife 8 and a spoon 9. The pins 7 separate the silverware 8, 9 so that it can reliably be washed.

The tray 1, which is best shown in FIG. 2 and FIG. 3, comprises two tray elements 10, 12, which are telescopably connected to each other at those lateral ends, which are slidably received by the side walls 3, 4 of the basket 2. Accordingly, the size of the tray 1 can be varied by telescoping the tray elements 10, 12 along the horizontal bars 5, 6.

The telescopable connection of the tray elements 10, 12 is realized by guiding means 14A, 16A; 14B, 16B, which are best seen in FIG. 5. The guiding means 14A, 16A; 14B, 16B, are provided in the form of essentially U-shaped profiles, which are guided into each other, whereas the outer profile encompasses the inner profile in order to hold it. Four stoppers 20, 22, 24, 26, are arranged at the ends of the guiding means 14A, 16A; 14B, 16B, to limit the movement of the tray elements 10, 12 relative to each other in both telescoping directions.

The tray 1 comprises fixing means or abutment means 30A, 30B, which are provided at the bottom side of the guiding means 14A, 16A; 14B, 16B, as best shown in FIG. 4. The fixing means or abutment means 30A are formed by essentially U-shaped recesses, which are resiliently clipable on the front horizontal bar 5 of the basket 2. The fixing means or abutment means 30B is provided in the form of a groove having an essentially semi-circular cross section and can be placed on the corresponding horizontal bar 6 of the rear wall 4 of the basket 2. These fixing means or abutment means 30A and 30B also guide the tray 1 during its sliding movement on the bars 5 and 6 of the basket 2. Moreover, they allow a pivoting movement of the tray 1 into an upright position in order to enable an easy loading/unloading of dishes in the portion of basket 2 underneath the tray 1 or if the tray 1 is not needed during the following cleaning cycle. Since the bars 5, 6 of the side walls 3, 4 are equally formed, the tray 1 can also be turned by 180 degrees in the horizontal plane.

The bottom wall 18 of the tray 1 comprises a surface which is permeable to water by slots or dots. This improves the rinsing quality when the tray 1 is sprayed with rinsing liquid.

The tray 1 can be arranged in a dishwasher, which is not shown in the figures. The dishwasher can comprise a feeding opening and two or more crockery baskets arranged one upon the other, which are, in a extraction direction, horizontally extractable and retractable through the feeding opening.

The tray 1 extends along the width or length of the upper basket and extends either along the extraction direction or perpendicular to the extraction direction, and is supported by the front side wall 3 and the back side wall 5 or side mesh or, not shown, by the left and the right side wall or side mesh.

In a perpendicular direction to the supporting side walls or side meshes 3 and 4, the tray is variable in its width or length.

FIG. 8 and FIG. 9 show a silverware basket 40 for a dishwasher, comprising two opposite side walls 42A, 44A and 42B, 44B and a base area 46, wherein the size of the basket 40 is horizontally variable by telescoping the two side walls 42A, 44A and 42B, 44B and the base area or bottom wall 46A, 46B.

The silverware basket comprises two parts. The first part comprises three side wall elements 42A, 43 and 42B and a base area element or bottom wall 46A. The second part comprises three side wall elements 44A, 47 and 44B and a base area element or bottom wall 46B. The two parts are shifted into each other to form the basket 40.

For varying the size of the basket, the two parts are telescopable with respect to each other.

The silverware basket 40 comprises a linear guidance in a side wall and a base area.

The front wall 43 and the back wall 47 of the silverware basket have a height which is larger than its width so that the silverware can be hold at least essentially in an upright position.

The silverware basket 40 comprises a handle 48 which spans between the two opposite side walls 42A, 44A and 42B, 44B.

The side walls 42A, 42B and 44A, 44B comprise slots or lamellar openings and the base area or bottom wall 46 A, 46B comprises dot-like openings which are permeable to water, so that water can get into and out of the basket. This surface improves the rinsing quality when the silverware basket 40 is sprayed with rinsing liquid.

The invention claimed is:

1. Silverware container for arrangement on a crockery basket of a dishwasher, wherein the silverware container comprises two opposing ends that are adapted for arrangement on upper ends of two opposing side walls of the crockery basket, wherein the silverware container comprises a bottom wall for supporting the silverware that comprises at least two essentially horizontal segments that are arranged telescopably relative to each other, wherein the horizontal segments of the bottom wall of the silverware container are telescopable perpendicularly to a longitudinal axis spanning the two opposing ends that are adapted for arrangement on the upper ends of the opposing side walls of the crockery basket, wherein each of the two opposing ends defines a guiding means configured to support the silverware container on the upper ends of the two opposing side walls of the crockery basket, wherein at least one guiding means includes at least a first U-shaped fixing means and a second U-shaped fixing means arranged telescopably with respect to each other, and wherein the first U-shaped fixing means and the second U-shaped fixing means each define a recess configured to substantially encompass the upper end of at least one side wall of the crockery basket, each recess having a same depth, such that the first U-shaped fixing means and the second U-shaped fixing means are configured to support the bottom wall of the silverware container in a horizontal orientation relative to the upper end of at least one side wall of the crockery basket.

2. Silverware container according to claim 1, wherein at least its bottom wall comprises at least one opening, slot, through hole or mesh hole so that water can get into or out of the silverware container.

3. Silverware container according to claim 1, wherein at least the area of the bottom wall and the lengths of two opposing side walls of the silverware container are variable by telescoping at least the telescopable horizontal segments of the bottom wall.

4. Silverware container according to claim 1 that is a silverware tray or a silverware basket for arrangement on a crockery basket of dishwasher.

5. Silverware container according to claim 4 that is a silverware tray, a) wherein the guiding means comprise a first guiding means and a second guiding means that are arranged respectively at opposing ends of the silverware tray as well as at least two tray elements that comprise the telescopable horizontal segments of its bottom wall, b) wherein the first guiding means is supported and telescopably arranged on the upper end of the first side wall of the crockery basket and the second guiding means is supported and telescopably arranged on the upper end of the second side wall of the crockery basket, c) whereas the size of the silverware tray is variable by telescoping the tray elements perpendicularly to the longitudinal axis spanning the opposing ends of the silverware tray and using the guiding means as telescopic guidance.

6. Silverware tray according to claim 5, wherein both the first and the second guiding means each comprises two elongated halves that are slidably arranged in parallel or concentrically to each other.

7. Silverware tray according to claim 5, a) wherein the first guiding means is supported and telescopably arranged on a first upper side wire of the first side wall of the crockery basket, b) wherein the second guiding means of the silverware tray is supported and telescopably arranged on a second upper side wire of the second side wall of the crockery basket, and c) wherein each upper side wire of the crockery basket extends at least essentially along the upper side of the respective side wall thereof.

8. Silverware tray according to claim 5, a) wherein the guiding means guide the movement of the tray elements, both relatively to each other and relatively to the first and second side wall of the cutlery basket, b) wherein at least one guiding means encompasses an upper side wire of the crockery basket.

9. Silverware tray according to claim 5, a) wherein at least one of the guiding means comprises an abutment means for detachably arranging the silverware tray on an upper side wire of a side wall of the crockery basket, or b) wherein at least one of the guiding means is pivotably engaged with one upper side wire of one of the opposing side walls of the crockery basket, or c) wherein at least one of the guiding means comprises a stopper for limiting the movement of at least one tray element relative to a neighboring tray element or relative to the first or second side wall of the crockery basket.

10. Silverware tray according to claim 5 that can be arranged on a crockery basket, a) wherein at least one upper side wire of the side walls of the crockery basket comprises a stop at at least one of its ends for limiting the sliding movement of the silverware tray.

11. Dishwasher comprising a crockery basket comprising the silverware container according to claim 1.

12. Silverware tray according to claim 6, wherein the two halves of each guiding means are arranged on two neighboring tray elements at corresponding ends thereof.

13. Silverware tray according to claim 7, wherein the upper side wire of the crockery basket extends at least substantially horizontally along the upper side of the respective side wall thereof.

14. Silverware tray according to claim 7, wherein the tray elements are telescopable along the first and the second side wire of the crockery basket.

15. Silverware tray according to claim 10, wherein the stop is provided as an upwardly extending section of the upper side wire.

16. Silverware container for arrangement on a crockery basket of a dishwasher, wherein the silverware container comprises two opposing ends that are adapted for arrangement on upper ends of two opposing side walls of the crockery basket, wherein the silverware container comprises a bottom wall for supporting the silverware that comprises at least two essentially horizontal segments that are arranged telescopably relative to each other, wherein the silverware container is a silverware tray and the horizontal segments of its bottom wall are telescopable perpendicularly to a longitudinal axis spanning the opposing ends of the silverware tray that are adapted for arrangement on the upper ends of the opposing side walls of the crockery basket, wherein each of the two opposing ends defines a guiding means configured to support the silverware tray on the upper ends of the two opposing side walls of the crockery basket, wherein at least one guiding means includes at least a first U-shaped fixing means and a second U-shaped fixing means arranged telescopably with respect to each other, and wherein the first U-shaped fixing means and the second U-shaped fixing means each define a recess configured to substantially encompass the upper end of at least one side wall of the crockery basket, each recess having a same depth, such that the first U-shaped fixing means and the second U-shaped fixing means are configured to support the bottom wall of the silverware container in a horizontal orientation relative to the upper end of at least one side wall of the crockery basket.

* * * * *

UNITED STATES PATENT AND TRADEMARK OFFICE

CERTIFICATE OF CORRECTION

PATENT NO. : 9,161,677 B2
APPLICATION NO. : 13/389736
DATED : October 20, 2015
INVENTOR(S) : Hofpeter et al.

It is certified that error appears in the above-identified patent and that said Letters Patent is hereby corrected as shown below:

On the Title page,
Item (75) Inventors: "Furth, DE (US)" should read --Furth (DE)--.

Signed and Sealed this
Eighth Day of March, 2016

Michelle K. Lee

Michelle K. Lee
*Director of the United States Patent and Trademark Office*